US005850826A

United States Patent [19]

Guthrie

[11] Patent Number: 5,850,826

[45] Date of Patent: Dec. 22, 1998

[54] PAINT BALL BLOW GUN DEVICE

[76] Inventor: Christopher L. Guthrie, 4716 Otisco Rd., Henryville, Ind. 47126

[21] Appl. No.: 708,532

[22] Filed: Sep. 5, 1996

[51] Int. Cl.[6] ..... F41B 1/00

[52] U.S. Cl. ..... 124/62

[58] Field of Search ..... 124/45, 51.1, 52, 124/53, 62, 72, 82

[56] References Cited

U.S. PATENT DOCUMENTS

| | | | |
|---|---|---|---|
| 278,005 | 5/1883 | Fredericks et al. | 124/62 |
| 430,572 | 6/1890 | Emlaw | 124/51.1 |
| 1,152,447 | 9/1915 | Sproull | 124/62 |
| 1,854,605 | 4/1932 | Tratsch | 124/76 |
| 2,427,490 | 9/1947 | Berrayarza et al. | 124/62 |
| 2,699,008 | 1/1955 | Tyler | 124/51.1 X |
| 2,888,003 | 5/1959 | Swanson | 124/62 |
| 3,388,696 | 6/1968 | Hoverath et al. | 124/62 |
| 3,521,616 | 7/1970 | Chang et al. | 124/51.1 X |
| 4,133,452 | 1/1979 | Wiltrout | 221/185 |
| 4,381,845 | 5/1983 | Feis | 221/185 |
| 4,586,482 | 5/1986 | DiPietro | 124/62 |

*Primary Examiner*—John A. Ricci

*Attorney, Agent, or Firm*—Woodard, Emhardt, Naughton, Moriarty & McNett

[57] ABSTRACT

A blow gun assembly for launching spherical projectiles. The assembly includes a loading chamber slidably received in a housing having loading, muzzle and air input apertures. The loading chamber is movable from a first position to a second position within the housing member, but is biased to its first position. When the loading chamber is in its first position the breech channel of the loading chamber is aligned with the muzzle aperture and the air input aperture to define a projectile launching pathway. When the loading chamber is in its second position the breech channel is aligned with the loading aperture to define a projectile loading pathway. Spherical projectiles such as paint balls are conveniently chambered in the blow gun with the inventive device.

16 Claims, 5 Drawing Sheets

PAINT BALL BLOW GUN DEVICE

BACKGROUND OF THE INVENTION

The present invention relates generally to devices for shooting paint balls, and more particularly to an attachment for converting a standard blow gun assembly to a multi-shot paint ball gun.

Traditional blow gun devices are simple, tube-like devices into which a single projectile is loaded and then fired. Recently, in order to compete with fast-paced activities such as paint ball games, blow gun devices having multiple shot magazines which facilitate loading and sequential firing of a number of projectiles have been desired. In several such designs, a number of projectiles are loaded in a storage container which is then connected to the tube area of the device. Projectiles can be fed either singly or continuously into the tube where they are then launched by forcing air through the tube.

Since the storage containers of these prior art devices feed directly into the tube, there can be an uncontrolled feed where more than one projectile is launched at a time or the projectiles may jam within the tube. Previous designs have often involved multiple and complex moving parts in order to control projectile loading.

Another aspect of one existing design is the use of a plunger which is pulled down to allow a projectile into a channel and then the plunger is returned to move the projectile into the launching pathway. This design aspect is taught by U.S. Pat. No. 2,888,003. However, this reference teaches the use of a spring which is pulled by the plunger and thus the spring may stretch. Furthermore, this reference requires that force be exerted against the plunger to push the projectile into the launching pathway and this force must be maintained while the projectile is being launched. Additionally, the reference teaches the use of a bent tubular structure along which the projectile is launched. This leads to reduced accuracy and momentum when the projectile is launched.

Consequently, a need exists for a blow gun assembly which provides for a multiple projectile magazine with controlled feeding of the projectiles to the launching pathway. Furthermore, the assembly should have minimal moving parts to avoid jamming or mechanical breakage. The present invention addresses these needs.

SUMMARY OF THE INVENTION

Briefly describing one aspect of the present invention, there is provided a blow gun assembly having a multiple projectile magazine which is mounted to a housing. A loading chamber member having a breech channel is manually pressed against the urging of a spring to align the breech channel with the loading aperture and the ammunition clip to define a loading pathway. Upon release, the spring urges the loading chamber member to return to its first position wherein the breech channel is aligned with the air input aperture and a muzzle aperture to define a projectile launching pathway. Selectively urging the loading chamber member to its second position and back allows for the convenient and speedy release of multiple projectiles with a minimum of effort and complexity.

Accordingly, it is an object of the present invention to provide a multiple projectile blow gun assembly which permits controlled feeding of one projectile at a time to the projectile launching pathway.

Another object of the present invention is to provide a blow gun assembly with few moving parts.

A further object of the present invention is to provide a blow gun assembly wherein the projectile launching pathway is not bent or obstructed.

Other objects, features, and advantages of the present invention shall become apparent from the detailed drawings and descriptions which follow.

DESCRIPTION OF THE PREFERRED EMBODIMENT

Figure 1:
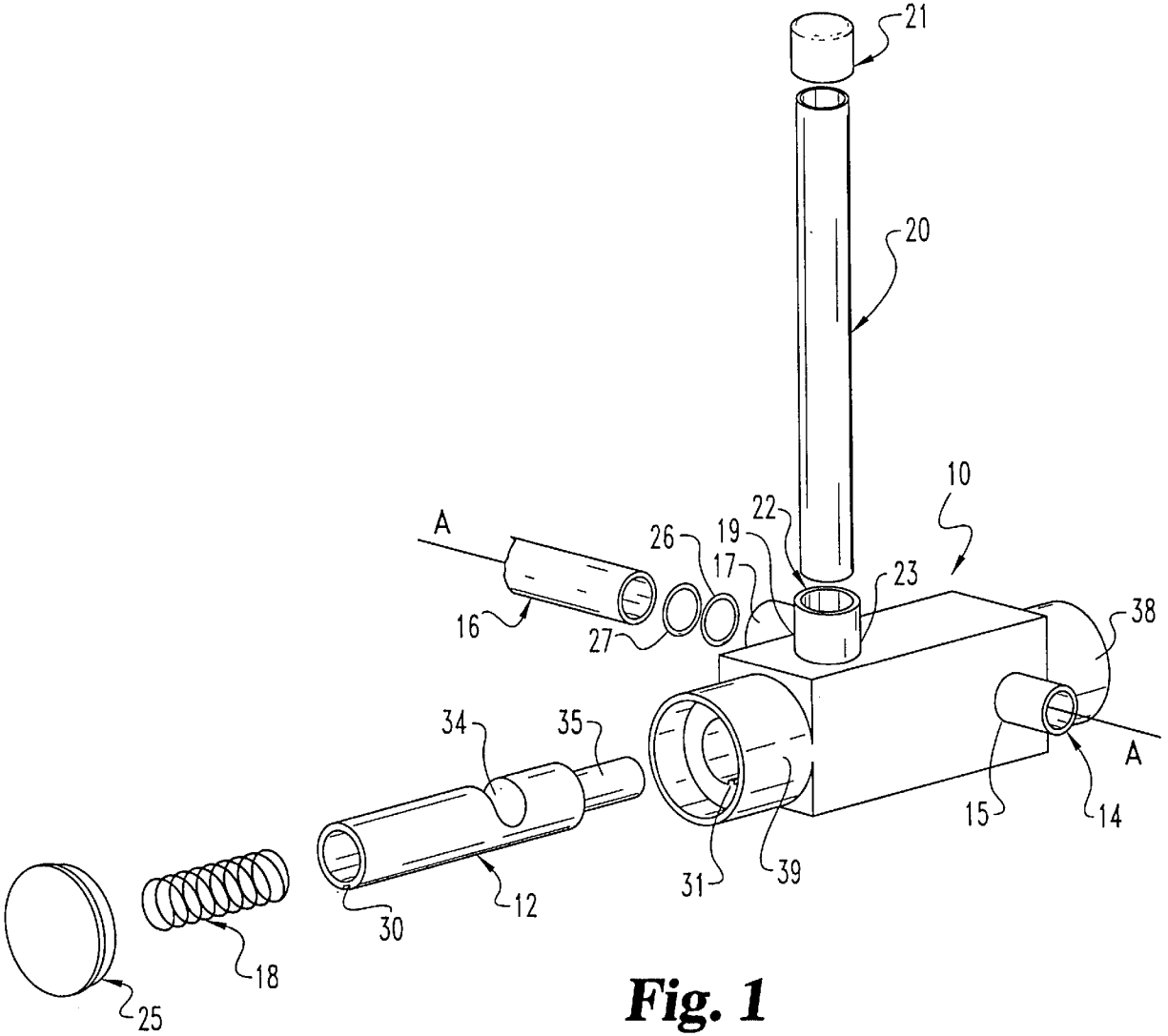
FIG. 1 is a perspective disassembled view of one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, a disassembled version of a preferred embodiment of the invention is shown. The blow gun assembly includes housing 10 having first end 38 and second end 39. Housing 10 also is provided with loading aperture 23, air input aperture 15 and muzzle aperture 19. Ammunition clip 20 closed at one end by a cap 21 engages a clip mount 22 which is secured to loading aperture 23. Mouthpiece mount 14 engages air input aperture 15 of housing 10. Barrel 16 engages rubber bushings 26 and 27 to secure barrel 16 to barrel mount 17 engaged with muzzle aperture 19 in the housing 10.

The blow pipe assembly further includes a loading chamber member 12 which has breach channel 34, push trigger 35 and groove 30. The loading chamber member 12 slidably engages an interior channel of housing 10 while groove 30 engages guide 31 which extends along the axis of the interior channel of housing 10. The engagement of groove 30 and guide 31 prevents rotational movement between loading chamber member 12 and housing 10.

Compression spring 18 is placed between loading chamber member 12 and spring retainer cap 25 to bias loading chamber member 12 to a first position. Cap 25 is affixed to second end 39 of housing 10.

Figure 2:
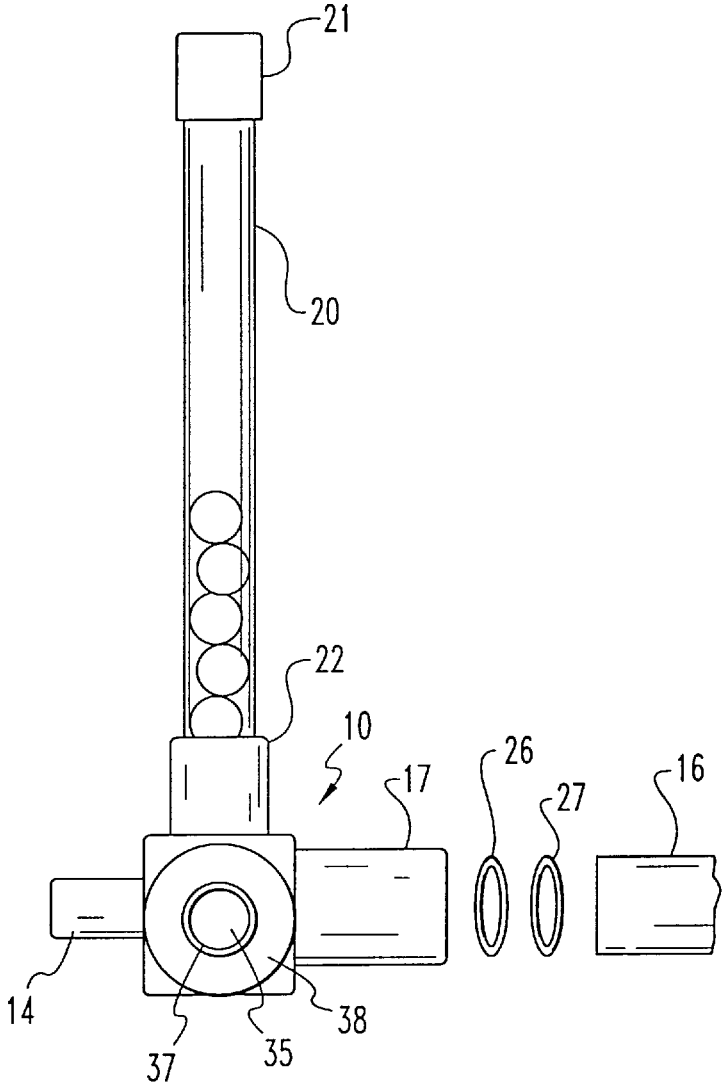
FIG. 2 is an assembled end view of the embodiment shown in FIG. 1.

FIG. 2 is an end-on view of first end 38 of housing 10 of the preferred embodiment of FIG. 1. When loading chamber member 12 is in its first position, push trigger 35 of loading chamber member 12 extends from housing 10 through opening 37 in the first end 38 of housing 10.

Figure 3:
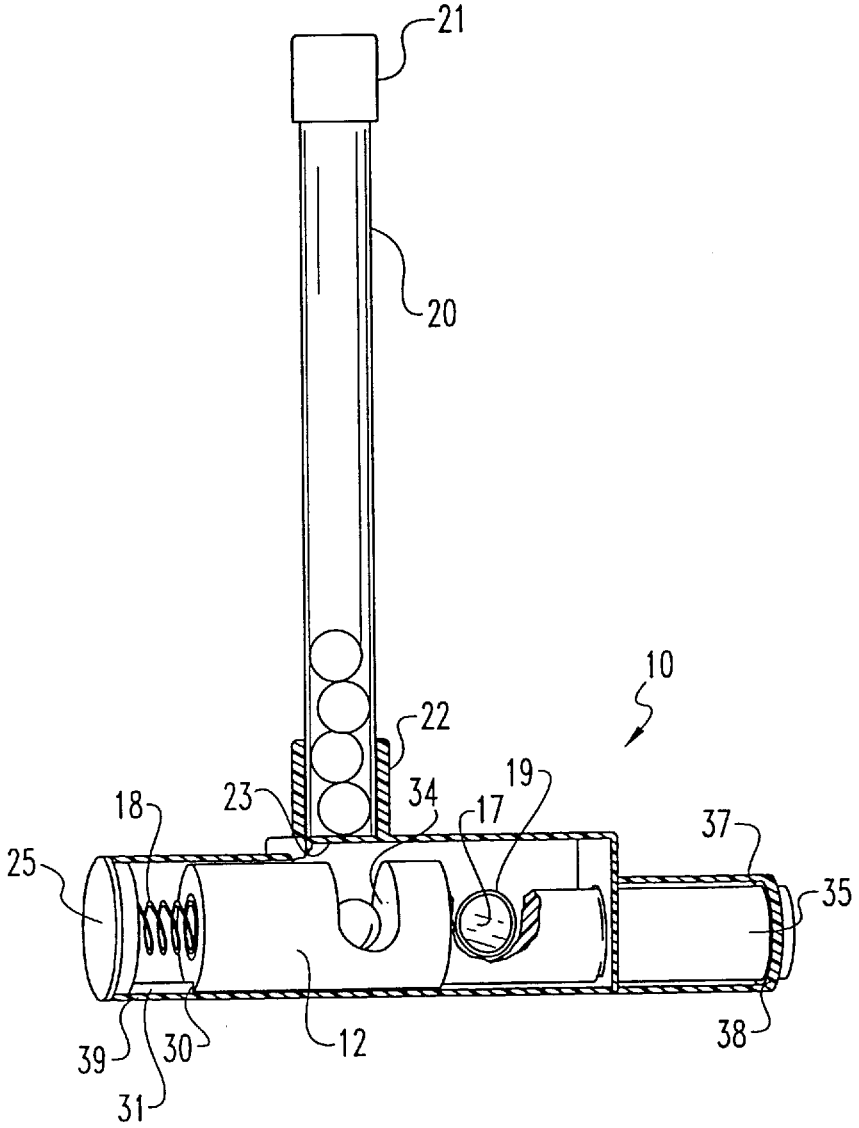
FIG. 3 is a perspective cut away view of one embodiment of the invention where the loading chamber member is in its second position.

FIG. 3 is a fragmentary view of a preferred embodiment of the invention wherein loading chamber member 12 is in sliding engagement with housing 12 and is in a second position. In this position, breech channel 34 of loading chamber member 12 is aligned with loading aperture 23 of housing 10 in order to form a loading pathway. Furthermore, in the illustrated embodiment ammunition clip 20 engages ammunition mount 22 to extend the ammunition loading pathway to include ammunition clip 20.

Figure 4:
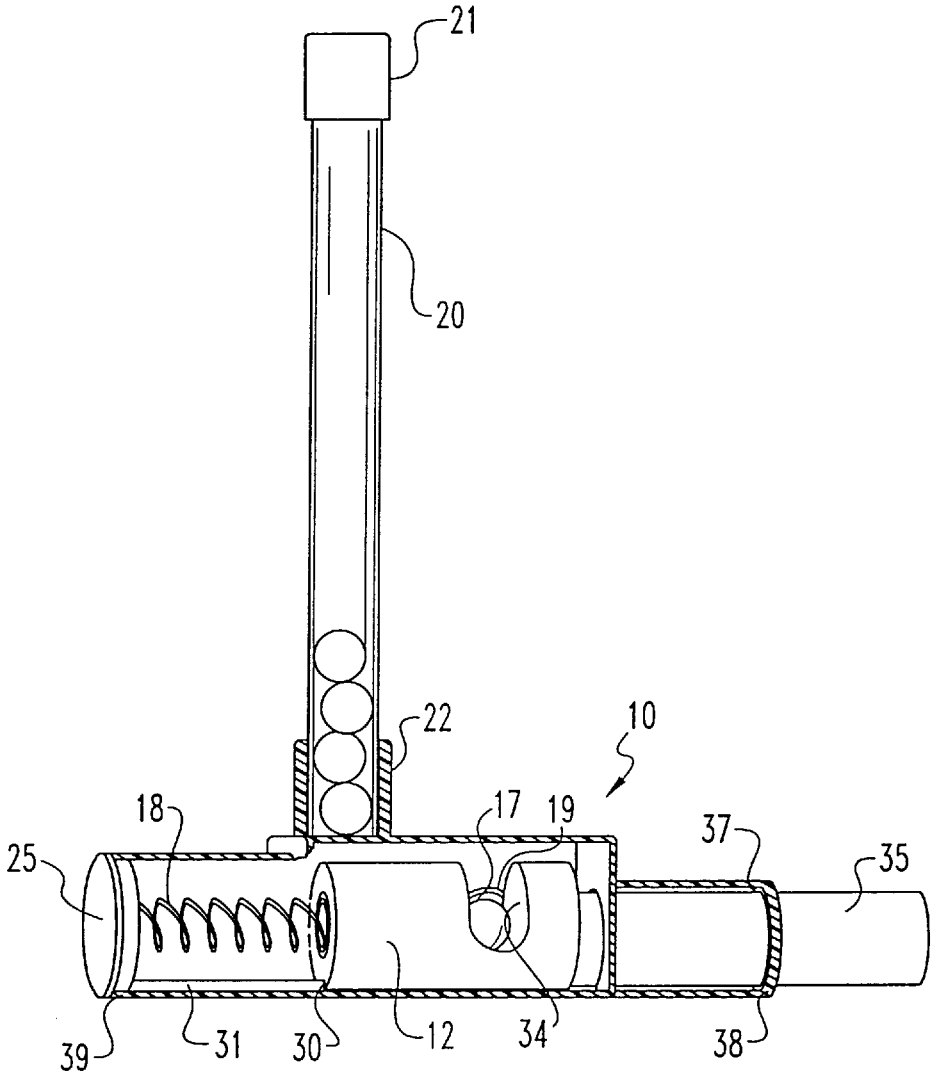
FIG. 4 is a perspective cut away view of the embodiment shown in FIG. 3 where the loading chamber member is in its first position.

FIG. 4 is a fragmentary view of the device of FIG. 1 with loading chamber 12 biased by spring 18 to its resting first position. In this position, breech channel 34 is aligned with muzzle aperture 19 and air input aperture 15 to form projectile launching pathway A. Furthermore, in this position, push trigger 35 of loading chamber member 12 extends through opening 37 in housing 10. Loading chamber member 12 is yieldingly urged into this first position by spring 18. It can be further seen that groove 30 of loading chamber member 12 engages guide 31 of the housing 10.

Figure 5:
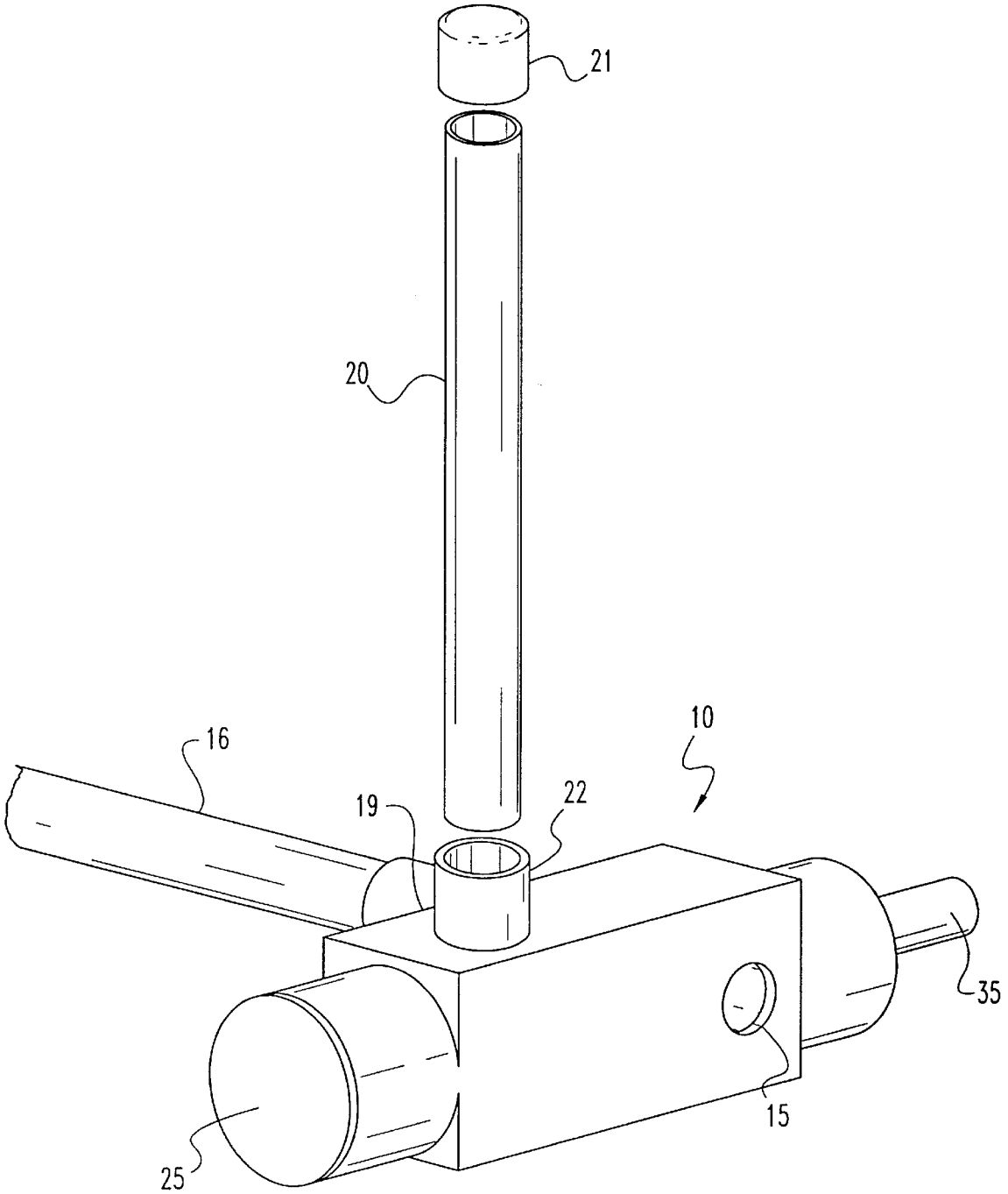
FIG. 5 is a perspective assembled view of an alternate embodiment of the present invention.

FIG. 5 illustrates an alternative embodiment of the invention. In FIG. 5 the blow gun assembly is illustrated from a perspective, assembled view wherein housing 10 is essentially as previously described. In this embodiment, barrel 16 directly engages muzzle aperture 19. Furthermore, there is no mouthpiece mount attached to air input aperture 15.

Having described the configuration of a preferred embodiment of the present invention, the operation of the present invention is next discussed. The blow gun assembly is loaded by placing projectiles within ammunition clip 20 and placing cap 21 on the distal end of ammunition clip 20 to retain the projectiles. Ammunition clip 20 is preferably engaged with loading mount 22 affixed to loading aperture 23 before the projectiles are loaded. Pressure is manually applied to push trigger 35 to urge loading chamber member 12 to its second position. When loading chamber member 12 is in its second position, a projectile will move along the projectile loading pathway from ammunition clip 20 through aperture 23 and into breech channel 34. Pressure is then released from push trigger 35 and compression spring 18 urges loading chamber member 12 back to its first position.

When loading chamber 12 is in its first position, breech channel 34 is aligned with air input aperture 15 and muzzle aperture 19 to form projectile launching pathway A. Air is then forced through air input aperture 15 and propels the projectile along projectile launching pathway A through breech channel 34, muzzle aperture 19 and barrel mount 17. The projectile then passes through barrel 16 and thus exits the blow gun assembly. Pressure may then be reapplied to push trigger 35 to repeat the above steps.

Once the supply of projectiles in storage chamber 20 is exhausted, cap 21 is removed and the supply of projectiles in ammunition clip 20 is replenished. Alternatively, ammunition clip 20 is removed from loading mount 22, the supply of projectiles is replenished and ammunition clip 20 is re-engaged with loading mount 22.

The preferred materials for the blow gun assembly consist of plastic, wood or metal as is understood by those of ordinary skill in the art. Similarly the preferred projectiles are paint balls although other projectiles such as peas, marbles, beans and other small objects are considered to be within the scope of the invention.

In the preferred embodiment of the invention, the ammunition clip 20 is a hollow cylindrical member with a circular cap. This hollow member engages clip mount 22. It will be understood that variously shaped and sized ammunition clips are contemplated as within the scope of this invention. Furthermore, the preferred ammunition clip is mounted radially from the housing; however various attachment angles are contemplated.

The preferred embodiment of the invention includes a mount for the ammunition clip, the barrel and the mouthpiece. It is understood that any or all of these could be made integral to or attachable in other ways to the housing. Similarly the use of various mouthpieces, barrels and storage containers as known by those with skill in the art are considered within the scope of this invention.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An assembly for launching spherical projectiles comprising:

a plastic or wooden housing member with a loading aperture for receiving projectiles, a muzzle aperture for releasing projectiles and an air input aperture for a supply of air, said housing member defining an interior channel;

a barrel mount engaged with said muzzle aperture of said housing member;

a mouthpiece mount engaged with said air input aperture of said housing member; and a loading chamber member having a breech channel;

wherein said loading chamber member is slidably received in the interior channel of said housing member; and wherein said loading chamber is movable from a first position to a second position within said housing member, and is biased to its first position;

wherein when said loading chamber is in its first position said breech channel is aligned with said muzzle aperture and said air input aperture to define a projectile launching pathway and wherein when said loading chamber is in its second position said breech channel is aligned with said loading aperture to define a projectile loading pathway.

2. The assembly of claim 1 and further comprising an ammunition clip to provide ammunition to said projectile loading pathway.

3. The assembly of claim 2 wherein said ammunition clip is comprised of a hollow cylindrical member and a clip mount coupled to said loading aperture of said housing wherein said hollow cylindrical member is releasably engagable with said loading aperture.

4. The assembly of claim 2 wherein said ammunition clip extends radially from said housing member.

5. The assembly of claim 1 and further comprising a spring engaged between said housing and said loading chamber member to yieldingly urge said loading chamber member towards its first position.

6. The assembly of claim 5 wherein said loading chamber member has a push trigger disposed oppositely of said spring, wherein said push trigger may be used to urge said loading chamber member from said first position to said second position.

7. The assembly of claim 1 wherein said housing has a guide extending along the axis of said interior channel and wherein said loading chamber member has a guide groove which engages said guide.

8. An assembly for launching spherical projectiles comprising:

a plastic or wooden housing member with a loading aperture for receiving projectiles, a muzzle for releasing projectiles and an air input aperture for a supply of air and said housing member further defining an interior channel;

a barrel engaged with said muzzle aperture of said housing member;

a loading chamber member having a breech channel wherein said loading chamber member is slidably received in said loading chamber is movable from a first position to a second position within said housing member;

wherein when said loading chamber is in its first position said breech channel is aligned with said muzzle aperture and said air input aperture to define a projectile launching pathway and wherein when said loading chamber is in its second position said breech channel is aligned with said loading to define a projectile loading pathway, and wherein said loading chamber is biased to its first position.

9. The assembly of claim 8 and further comprising a spring engaged between said housing and said loading chamber member to yieldingly urge said loading chamber member towards its first position.

10. The assembly of claim 9 wherein said loading chamber member has a push trigger disposed oppositely of said spring, wherein said push trigger may be used to urge said loading chamber member from said first position to said second position.

11. The assembly of claim 8 and further comprising an ammunition clip to provide ammunition to said projectile loading pathway.

12. The assembly of claim 8 wherein said air input aperture is configured as a mouthpiece.

13. An assembly for launching spherical projectiles comprising:

a plastic or wooden housing member with a loading aperture for receiving projectiles, a muzzle aperture for releasing projectiles and an air input aperture for a supply of air and said housing member further defining an interior channel;

a loading chamber member having a breech channel wherein said loading chamber member is slidably received in said interior channel of said housing member and wherein said loading chamber is movable from a first position to a second position within said housing member;

wherein when said loading chamber is in its first position said breech channel is aligned with said muzzle aperture and said air input aperture to define a projectile launching pathway and wherein said loading chamber is in its second position said breech channel is aligned with said loading aperture to define a projectile loading pathway, and wherein said loading chamber is biased to its first position.

14. The assembly of claim 13 and further comprising a spring engaged between said housing and said loading chamber member to yieldingly urge said loading chamber member towards its first position.

15. The assembly of claim 13 and further comprising an ammunition clip integral to said housing member which engages said loading aperture.

16. An assembly for launching spherical projectiles comprising:

a plastic or wooden housing member with a loading aperture for receiving projectiles, a muzzle aperture for releasing projectiles and an air input aperture for a supply of air, said housing member defining an interior channel;

a barrel mount engaged with said muzzle aperture of said housing member;

a mouthpiece mount engaged with said air input aperture of said housing member;

a loading chamber member having a breech channel, said loading chamber member being slidably received in the interior channel of said housing member and movable from a first position to a second position within said housing member, wherein when said loading chamber is in its first position said breech channel is aligned with said muzzle aperture and said air input aperture to define a projectile launching pathway, and wherein when said loading chamber is in its second position said breech channel is aligned with said loading aperture to define a projectile loading pathway; and biasing means enclosed in said housing member for biasing said loading chamber to its first position.

* * * * *